US011230103B2

(12) United States Patent
Suzuki

(10) Patent No.: US 11,230,103 B2
(45) Date of Patent: Jan. 25, 2022

(54) HEAD UNIT AND LIQUID EJECTION APPARATUS

(71) Applicant: SEIKO EPSON CORPORATION, Tokyo (JP)

(72) Inventor: Shigeki Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/890,192

(22) Filed: Jun. 2, 2020

(65) Prior Publication Data

US 2020/0376838 A1 Dec. 3, 2020

(30) Foreign Application Priority Data

Jun. 3, 2019 (JP) ..... JP2019-103521

(51) Int. Cl.

| | |
|---|---|
| ***B41J 2/14*** | (2006.01) |
| ***B41J 2/16*** | (2006.01) |
| ***B41J 2/145*** | (2006.01) |
| ***B41J 2/165*** | (2006.01) |

(52) U.S. Cl.

CPC ..... *B41J 2/145* (2013.01); *B41J 2/1433* (2013.01); *B41J 2/16505* (2013.01)

(58) Field of Classification Search

CPC ..... B41J 2/145; B41J 2/1433; B41J 2/16505; B41J 2/165

See application file for complete search history.

(56) References Cited

U.S. PATENT DOCUMENTS

| | | | | |
|---|---|---|---|---|
| 2010/0149253 | A1* | 6/2010 | Kusunoki | B41J 2/16538 347/33 |
| 2014/0152745 | A1* | 6/2014 | Park | B41J 2/175 347/86 |
| 2015/0246544 | A1* | 9/2015 | Watanabe | B41J 2/14233 347/33 |
| 2016/0243835 | A1* | 8/2016 | Shinbara | B41J 2/16538 |
| 2017/0057227 | A1* | 3/2017 | Ozawa | B41J 2/1606 |
| 2018/0201020 | A1 | 7/2018 | Mori | |
| 2018/0236797 | A1 | 8/2018 | Ohashi et al. | |

FOREIGN PATENT DOCUMENTS

| | | |
|---|---|---|
| JP | 2001-121709 | 5/2001 |
| JP | 2017-047585 | 3/2017 |
| JP | 2018-114744 | 7/2018 |
| JP | 2018-130960 | 8/2018 |

* cited by examiner

*Primary Examiner* — Jason S Uhlenhake

(74) *Attorney, Agent, or Firm* — Workman Nydegger

(57) ABSTRACT

A head unit includes a first ejection head having a first nozzle surface including first nozzles configured to eject liquid, wherein a first region having water repellency is provided on a first side on a first axis with respect to a range in which the first nozzles are formed, the first axis extending along the first nozzle surface, and a second region having water repellency lower than the first region is provided on a second side on the first axis with respect to the range in which the first nozzles are formed.

20 Claims, 9 Drawing Sheets

HEAD UNIT AND LIQUID EJECTION APPARATUS

The present application is based on, and claims priority from JP Application Serial Number 2019-103521, filed Jun. 3, 2019, the disclosure of which is hereby incorporated by reference herein in its entirety.

BACKGROUND

1. Technical Field

The present disclosure relates to a head unit and a liquid ejection apparatus.

2. Related Art

A liquid ejection apparatus such as an ink jet printer includes a head unit. It is known that mist generated in the head unit with ejection of ink is not attached to a recording medium but floats inside the printer. Liquid droplets derived from such mist may be attached to a nozzle forming surface on which nozzles are formed. In order to address this issue, a region having water repellency can be provided on the nozzle forming surface to facilitate removal of the attached liquid by a maintenance operation such as wiping. On the other hand, in the ink jet printer disclosed in JP-A-2018-114744, the head unit is provided inclined relative to the horizontal direction, and ink is ejected onto a recording paper from obliquely above.

However, when the inclined head unit is used and the nozzle forming surface has water repellency, the attached droplets may flow down along the nozzle forming surface due to the water repellency and the inclination, and may grow into a large droplets. As a consequence, since the nozzle forming surface has high water repellency, in other words, a low critical surface tension, the droplets may grow large, and the large droplets may be attached to the recording medium, causing stains.

SUMMARY

According to a first aspect of the present disclosure, a head unit including a first ejection head having a first nozzle surface on which a plurality of first nozzles that eject liquid are disposed is provided. In this head unit, a first region having water repellency is provided on a first side on a first axis relative to a range in which the plurality of first nozzles are formed, the first axis extending along the first nozzle surface, and a second region having water repellency lower than the first region is provided on a second side on the first axis relative to the range in which the plurality of first nozzles are formed.

According to a second aspect of the present disclosure, a head unit including a first ejection head having a first nozzle surface on which a plurality of first nozzles that eject liquid are disposed is provided. In this head unit, a first region is provided on a first side on a first axis relative to a range in which the plurality of first nozzles are formed, the first axis extending along the first nozzle surface, and a second region having a critical surface tension larger than the first region is provided on a second side on the first axis relative to the range in which the plurality of first nozzles are formed.

According to a third aspect of the present disclosure, a liquid ejection apparatus is provided. This liquid ejection apparatus includes a head unit that includes an ejection head having a nozzle surface on which nozzles that eject liquid are disposed; and a control unit that controls the head unit to perform an ejection operation with the nozzle surface intersecting a horizontal plane, wherein a first region having water repellency is provided on an upper side relative to the region in which the nozzles are formed, and a second region having water repellency lower than the first region is provided on a lower side relative to the region in which the nozzles are formed.

According to a fourth aspect of the present disclosure, a liquid ejection apparatus is provided. This liquid ejection apparatus includes a head unit that includes an ejection head having a nozzle surface on which nozzles that eject liquid are disposed; and a control unit that controls the head unit to perform an ejection operation with the nozzle surface intersecting a horizontal plane, wherein a first region is provided on an upper side relative to the region in which the nozzles are formed, and a second region having a critical surface tension larger than the first region is provided on a lower side relative to the region in which the nozzles are formed.

DESCRIPTION OF EXEMPLARY EMBODIMENTS

A. First Embodiment

Figure 1:
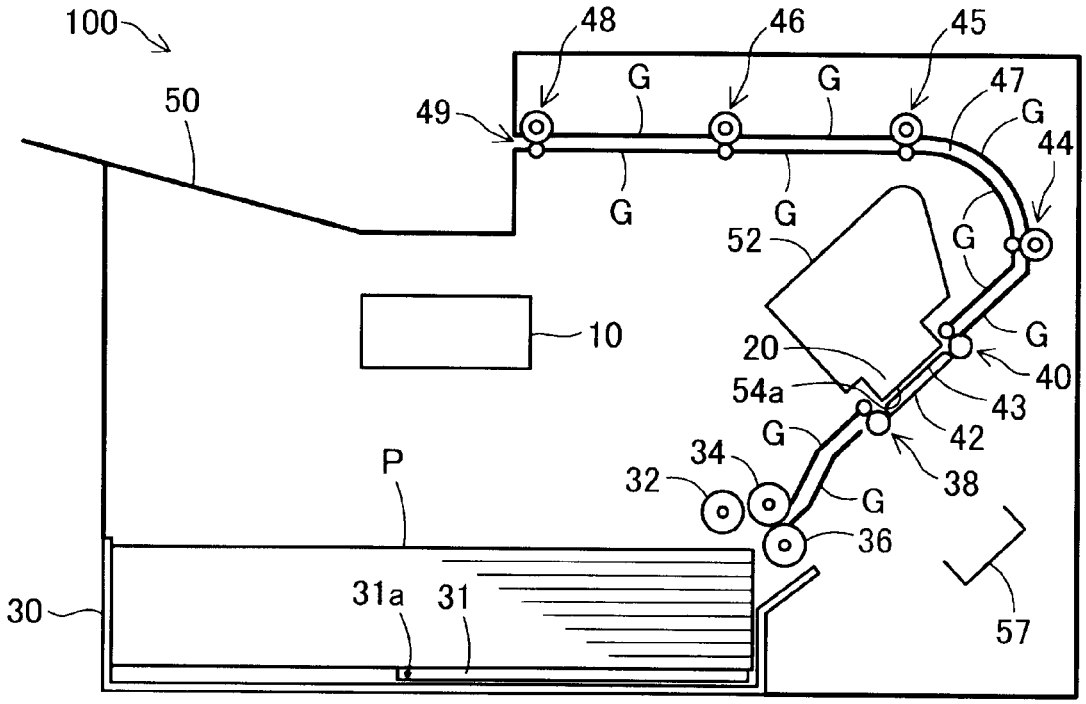
FIG. 1 is a schematic view of a general configuration of a liquid ejection apparatus.

FIG. 1 is a schematic view of a general configuration of a liquid ejection apparatus 100 in which a head unit 52 is mounted according to a first embodiment of the present disclosure. The liquid ejection apparatus 100 is an ink jet printer that performs printing by ejecting ink droplets, which is an example of liquid, onto a medium. The medium may be any printing object made of any material such as a resin film or cloth.

In FIG. 1, the liquid ejection apparatus 100 is provided with a paper sheet cassette 30 that accommodates the sheets of recording paper P, which are examples of the medium, on the bottom of the apparatus in a detachable manner. The paper sheet cassette 30 includes a hopper 31 such that the hopper 31, when receiving a driving force from a driving source (not shown), swings about a swing shaft 31*a* to cause the sheets of recording paper P accommodated in the paper sheet cassette 30 to come into contact with and separate from a feed roller 32, which is rotated by a motor (not shown).

The sheets of recording paper P fed out from the paper sheet cassette 30 by the feed roller 32 pass through a nip position between a feeding roller 34 and a separation roller 36 to be thereby separated and fed downstream, and then reach an upstream transport roller pair 38. Hereinafter, a transport path from the paper sheet cassette 30 to the upstream transport roller pair 38 is referred to as a "supply transport path." The paper sheet transport path between the upstream transport roller pair 38 and a downstream transport roller pair 40 is formed as a head-facing region 43 where the recording paper P faces the ejection head 20. In the head-facing region 43, recording is performed by the ejection head 20 onto the recording paper P. A platen 42 that supports the recording paper P is disposed in the head-facing region 43. Hereinafter, a transport path from the upstream transport roller pair 38 to the downstream transport roller pair 40 is referred to as a "recording transport path."

In the present embodiment, the head-facing region 43 that constitutes the recording transport path of the liquid ejection apparatus 100 is inclined relative to the horizontal direction. Further, the supply transport path is inclined in a direction along the inclination of the recording transport path and joined to the recording transport path. That is, the supply transport path and the recording transport path are joined in a substantially straight line. The supply transport path, the recording transport path, and an output path 47, which will be described later, are collectively referred to as a "paper sheet transport path." A guide member G constitutes a part of the paper sheet transport path.

In the liquid ejection apparatus 100, a downstream portion of the paper sheet transport path from the head-facing region 43 is configured as the output path 47 that provides a curved path while the head unit 52 is disposed inside the output path 47 so that the recording paper P is outputted along the output path 47 with the face down. After recording is performed, the recording paper P is curved and reversed with the recording surface inside, and fed along the output path 47. More specifically, the output path 47 is a transport path from the downstream transport roller pair 40 to an output roller pair 48. A plurality of feeding roller pairs 44, 45, and 46 are provided between the downstream transport roller pair 40 and the output roller pair 48.

The recording paper P transported in the output path 47 is outputted toward an output tray 50 with the recording surface facing down by the output roller pair 48 which is provided at a paper sheet output port 49.

The liquid ejection apparatus 100 includes the head unit 52 at a position facing the head-facing region 43. As described above, the head-facing region 43 is inclined relative the horizontal direction. Accordingly, the head unit 52 is also inclined relative to the horizontal direction. The head unit 52 is provided with an ejection head 20. The ejection head 20 includes a nozzle surface 54*a* on which nozzles 25 that eject liquid are provided. The nozzle surface 54*a* is inclined relative to the horizontal direction. More specifically, the nozzle surface 54*a* is inclined such that a normal vector from the nozzle surface 54*a* toward the head-facing region 43 has a downward vector component in the gravitational direction.

The liquid ejection apparatus 100 includes one or more control units 10. The control unit 10 controls the head unit 52 to perform an ejection operation in a state in which the nozzle surface 54*a* is inclined relative to the horizontal direction. The liquid ejection apparatus 100 of the present embodiment is a serial printer. The control unit 10 performs recording of an image or the like on the recording paper P by ejecting ink toward the recording paper P while reciprocating the head unit 52 in the width direction of the recording paper P.

The liquid ejection apparatus 100 includes a cap 57 having a box shape with one side open. The cap 57 seals a nozzle surface 54*a* when the ejection operation of the head unit 52 is not performed by the control unit 10. As the cap 57 seals the nozzle surface 54*a* of the ejection head 20, ink in the head unit 52 is prevented from being dried. Further, flushing can be performed while the cap 57 seals the nozzle surface 54*a* of the ejection head 20, or the cap 57 faces the nozzle surface 54*a* of the ejection head 20. Flushing is an operation of ejecting ink from the ejection head 20 onto the inside of the cap 57. In FIG. 1, the cap 57 is illustrated at a position away from the head unit 52. However, the cap 57 is actually located at a position capable of facing the head unit 52 when the head unit 52 moves to a home position.

Figure 2:
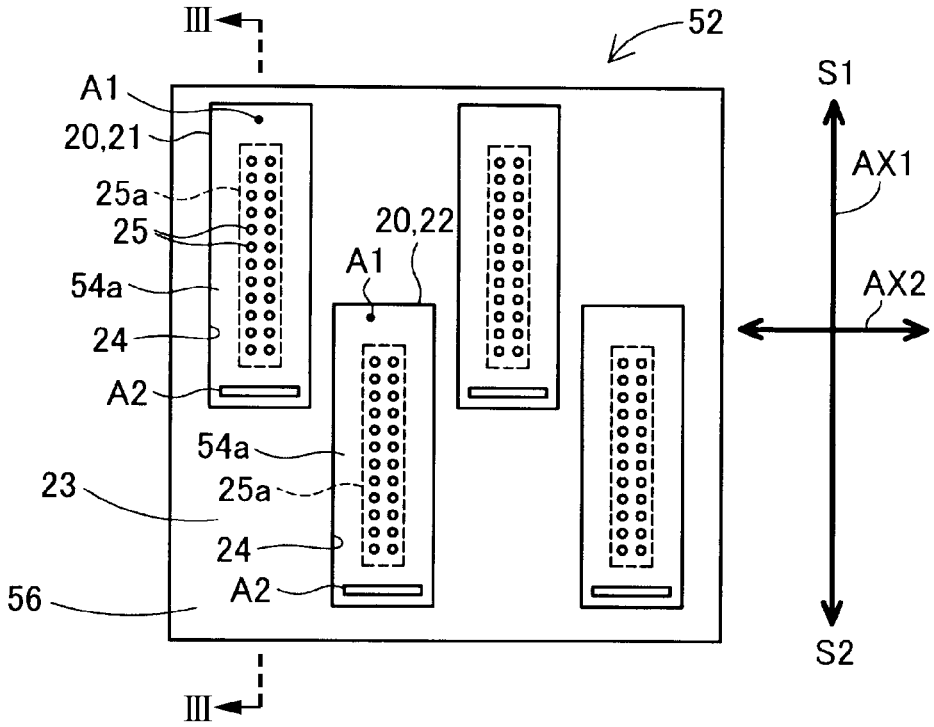
FIG. 2 is a view illustrating a configuration of a medium-facing surface of a head unit.

FIG. 2 is a view illustrating a configuration of a medium-facing surface 56 of the head unit 52. Hereinafter, a surface of the head unit 52 on which the nozzle surface 54*a* is provided is referred to as a "medium-facing surface 56." In FIG. 2, a first axis AX1 and a second axis AX2 are shown. The first axis AX1 is an axis extending along the nozzle surface 54*a*. The second axis AX2 is an axis crossing the axis AX1 and extending along the nozzle surface 54*a*. In FIG. 2, the second axis AX2 is an axis being perpendicular to the axis AX1 and extending along the nozzle surface 54*a*. In FIG. 2, a first side on the first axis AX1 denoted as "S1" is an upper side in the gravitational direction, whereas a second side denoted as "S2" is a lower side in the gravitational direction. Both the first axis AX1 and the second axis AX2 are not actual axes, but virtual axes for defining various directions.

As shown in FIG. 2, the head unit 52 includes a plurality of ejection heads 20, including a first ejection head 21 and a second ejection head 22. In the present embodiment, the second ejection head 22 is provided at a position different from the first ejection head 21. Specifically, the positions of the second ejection head 22 and the first ejection head 21 are different in the second axis AX2, and the second ejection head 22 is positioned on a side close to the second side in the first axis AX1 than the first ejection head 21 is. The head unit 52 includes a fixation plate 23 that faces the platen 42. A plurality of rectangular openings 24 are formed in the fixation plate 23. The ejection heads 20 are fixed to the fixation plate 23 such that the nozzle surfaces 54*a* of the respective ejection heads 20 are exposed from the respective openings 24. Each nozzle surface 54*a* has a forming range of the nozzles 25. Hereinafter, the forming range of the nozzles 25 is referred to as a "nozzle forming range 25*a*." In the nozzle forming range 25*a* in the present embodiment, a plurality of nozzles 25 are arranged in two rows in the first axis AX1. The number of rows of the nozzles 25 may be one, or three or more.

Figure 3:
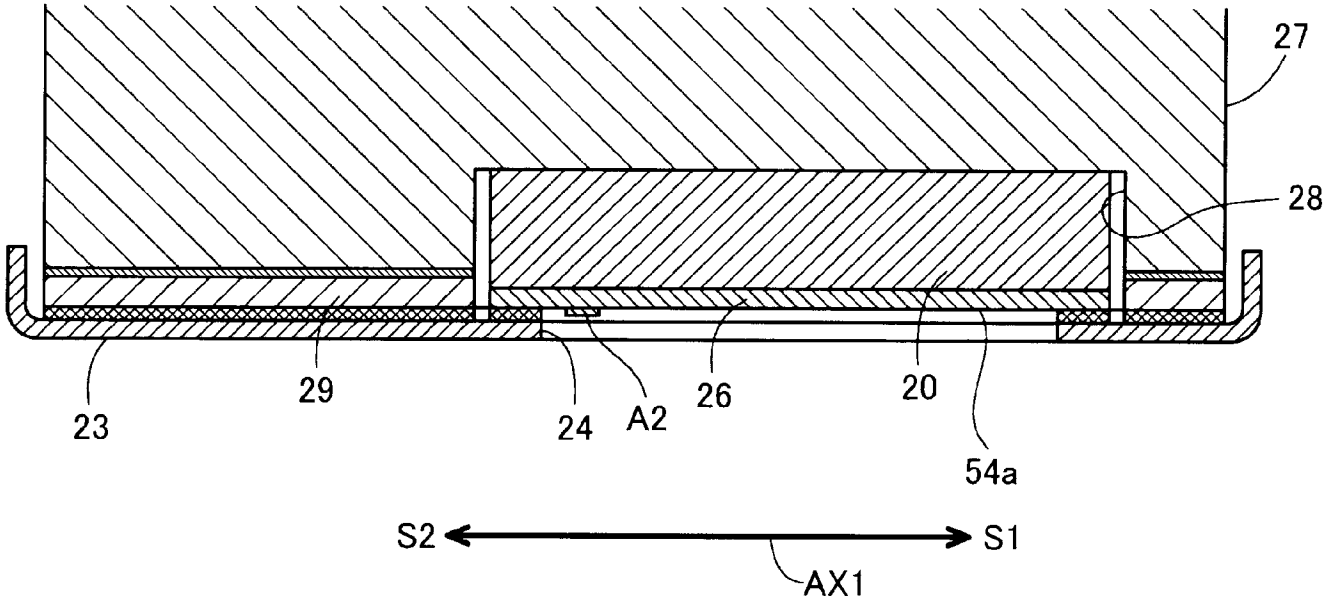
FIG. 3 is a cross-sectional view taken along the line III-III of FIG. 2.

FIG. 3 is a cross-sectional view taken along the line III-III of FIG. 2. As shown in FIG. 3, the opening 24 of the fixation plate 23 is formed slightly smaller than the nozzle plate 26 provided on the ejection head 20. The nozzle plate 26 is a plate member in which the nozzles 25 are formed. The nozzle plate 26 is made of, for example, a stainless steel. A surface of the nozzle plate 26 which is exposed from the opening 24 is the nozzle surface 54*a*. The periphery of the nozzle plate 26 is bonded to the rear surface of the fixation plate 23, more specifically, to the rear surface of the periphery of the opening 24, via an adhesive. The ejection head 20 is accommodated in a head accommodating portion 28 formed in a holder 27 for holding the ejection head 20. The holder 27 is fixed to the fixation plate 23 via an adhesive with a reinforcing plate 29 interposed therebetween.

As shown in FIGS. 2 and 3, in the present embodiment, a first region A1 having water repellency is provided on the nozzle surface 54*a* on the first side on the first axis AX1 relative to the nozzle forming range 25*a*. Further, in the present embodiment, a second region A2 having water repellency lower than the first region A1 is provided on the second side on the first axis AX1 relative to the nozzle forming range 25*a*. In other words, the first region A1 is provided on the first side on the first axis AX1 relative to the nozzle forming range 25*a*, and the second region A2 having a critical surface tension larger than the first region A1 is provided on the second side on the first axis AX1 relative to the nozzle forming range 25*a*. In FIG. 2 and the like, the first region A1 is indicated by the small black dot. However, this is for convenience of illustration, and the actual first region A1 is a region extending around the black dot. The water repellency and the critical surface tension in the first region A1 and the second region A2 can be compared by dropping the same type of droplet on the first region A1 and the second region A2 oriented upward, and measuring the contact angle of the droplet relative to each region. A large contact angle means that the water repellency of the region is high, and the critical surface tension of the region is small. Further, the critical surface tension of each region can also be called a surface free energy.

In the present embodiment, the second region A2 having low water repellency is formed by applying a hydrophilic coating such as a glass coating along the second axis AX2 on the nozzle surface 54*a* on the second side relative to the nozzle forming range 25*a*. Further, the first region A1 is formed by applying a water repellent coating such as a fluorine coating on a region other than the second region A2. That is, in the present embodiment, the water repellent region is provided on the nozzle surface 54*a* not only on the first side on the first axis AX1 relative to the nozzle forming range 25*a*, but also on the entire region other than the second region A2. In another embodiment, the first region A1 may be provided only on the first side on the first axis AX1 relative to the nozzle forming range 25*a*. In addition, the second region A2 may also be provided on the first side relative to the nozzle forming range 25*a* in addition to the second side. However, from the viewpoint of the effect of the second region A2 described later, the second region A2 is preferably not provided on the first side.

According to the present embodiment described above, the first region A1 having water repellency is provided on the first side on the first axis AX1 relative to the nozzle forming range 25*a*, and the second region A2 having water repellency lower than the first region A1 is provided on the second side. Accordingly, if the droplet derived from mist is attached to the nozzle surface 54*a* of the inclined head unit 52 and flows down along the nozzle surface 54*a*, the droplet wet-spreads in the second region A2 and is unlikely to grow into a large droplet since the second region A2 has low water repellency. Therefore, it is possible to reduce the possibility of the droplet derived from mist being attached to the recording paper P that faces the nozzle surface 54*a* and generating a stain.

B. Second Embodiment

Figure 4:
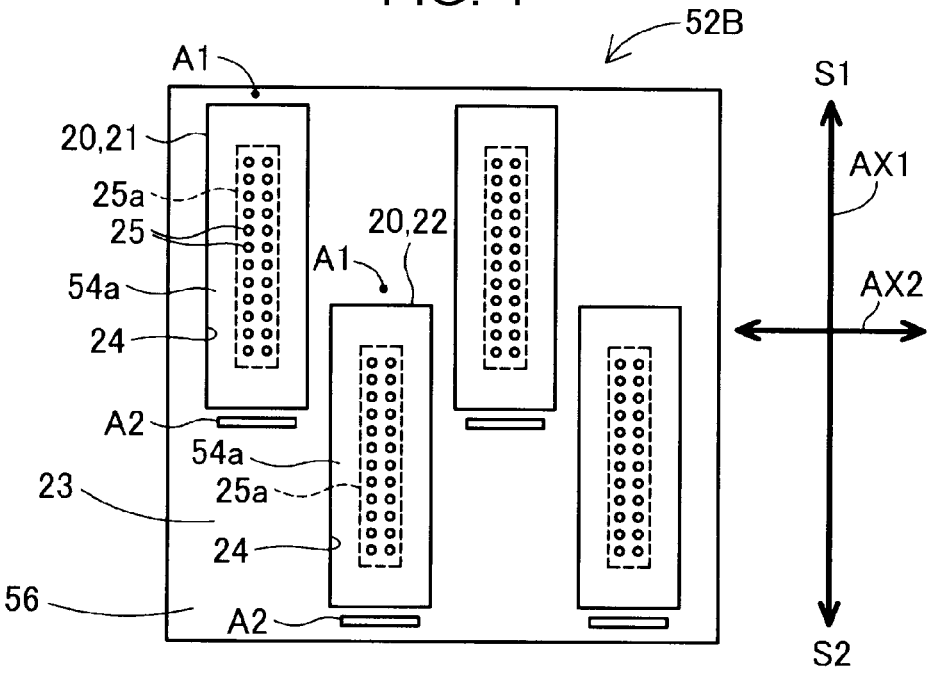
FIG. 4 is a view illustrating a medium-facing surface of a head unit according to a second embodiment.

FIG. 4 is a view illustrating a medium-facing surface 56 of the head unit 52B according to a second embodiment. In the first embodiment, the first region A1 and the second region A2 are provided on the nozzle surface 54*a*. On the other hand, in the second embodiment, the first region A1 and the second region A2 are provided on the fixation plate 23. With this configuration, it is possible to prevent droplets from growing on the fixation plate 23 and staining the recording paper P.

Further, in the head unit 52B, both the first region A1 and the second region A2 may not be necessarily provided on the fixation plate 23. For example, only the first region A1 may be provided on the nozzle surface 54*a*, and the second region A2 may be provided on the fixation plate 23. Alternatively, only the second region A2 may be provided on the nozzle surface 54*a*, and the first region A1 may be provided on the fixation plate 23. That is, on the medium-facing surface 56 of the head unit 52, the first region A1 and the second region A2 may be provided on either the nozzle surface 54*a* or the fixation plate 23 as long as the first region A1 is provided on the first side on the first axis AX1 relative to the nozzle forming range 25*a*, and the second region A2 is provided on the second side.

C. Third Embodiment

Figure 5:
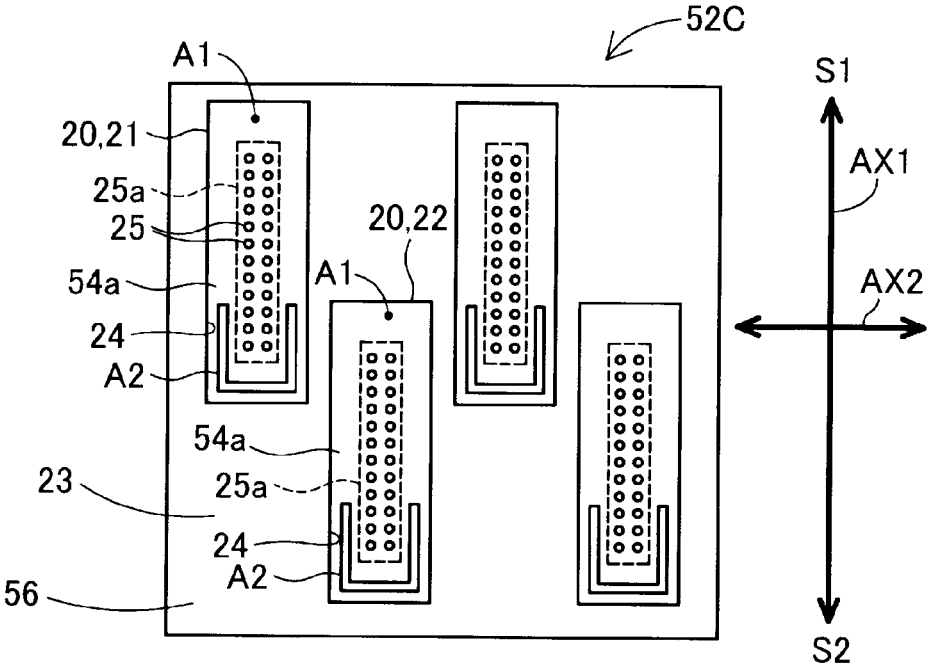
FIG. 5 is a view illustrating a medium-facing surface of a head unit according to a third embodiment.

FIG. 5 is a view illustrating a medium-facing surface 56 of the head unit 52C according to a third embodiment. In the third embodiment, on the nozzle surface 54*a*, the second side of the nozzle forming range 25*a* is partially surrounded by the second region A2 formed in a U-shape. That is, the second region A2 having a water repellency lower than the first region A1 is provided at least on the first side on the second axis AX2 relative to the nozzle forming range 25*a*. In the present embodiment, the second region A2 is provided on the first and second sides on the second axis AX2 relative to the nozzle forming range 25*a*. With this configuration, since droplets can wet-spread in the horizontal direction of the nozzle forming range 25*a*, droplets can be easily caught in the second region A2 during reciprocation of the head unit 52C. Therefore, it is possible to effectively prevent droplets caused by the mist attached to the head unit 52C from being attached to the recording paper P.

D. Fourth Embodiment

Figure 6:
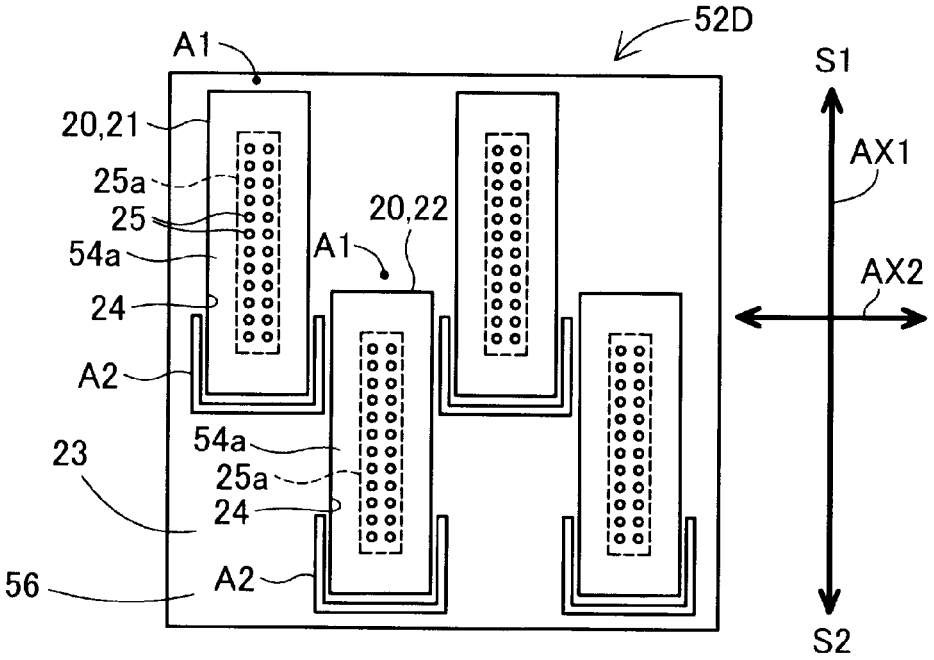
FIG. 6 is a view illustrating a medium-facing surface of a head unit according to a fourth embodiment.

FIG. 6 is a view illustrating a medium-facing surface 56 of the head unit 52D according to a fourth embodiment. In the fourth embodiment, on the fixation plate 23, the second side of the nozzle forming range 25*a* is partially surrounded by the second region A2 formed in a U-shape. With this configuration as well, as in the third embodiment, it is possible to effectively prevent droplets caused by the mist attached to the head unit 52D from being attached to the recording paper P.

E. Fifth Embodiment

Figure 7:
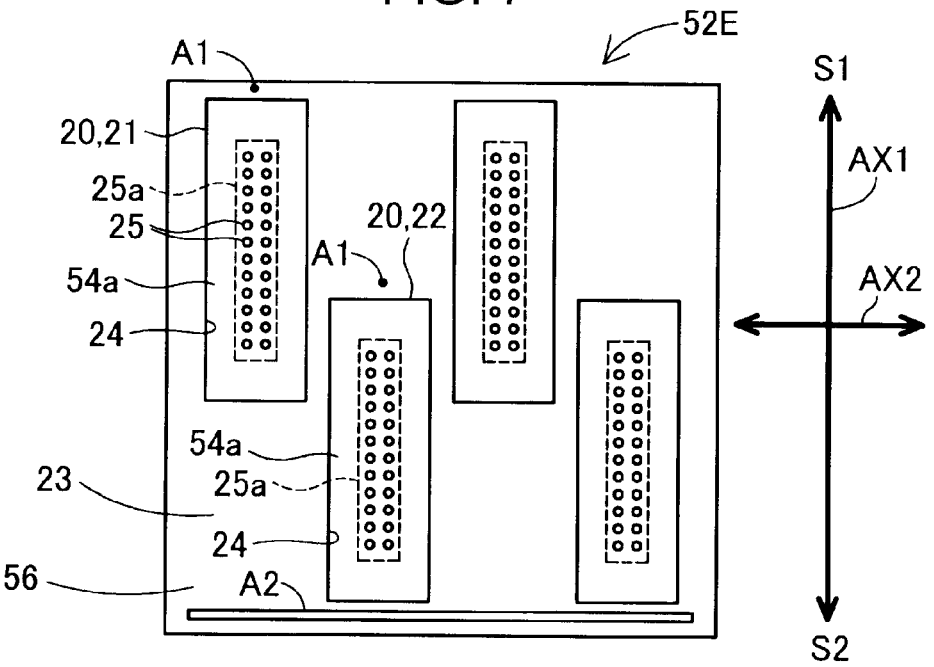
FIG. 7 is a view illustrating a medium-facing surface of a head unit according to a fifth embodiment.

FIG. 7 is a view illustrating a medium-facing surface 56 of the head unit 52E according to a fifth embodiment. In the present embodiment, one second region A2 common to the plurality of ejection heads 20 of the head unit 52E is provided extending in the second axis AX2 on the second side of the nozzle forming range 25*a*. That is, a common second region A2 is provided on the second side relative to the nozzle forming range 25*a* of the first ejection head 21 and on the second side relative to the nozzle forming range 25*a* of the second ejection head 22. With this configuration as well, it is possible to prevent droplets caused by the mist attached to the head unit 52E from being attached to the recording paper P. Further, since the second region A2 can be provided common to the respective ejection heads 20, the head unit 52E can be easily produced.

F. Sixth Embodiment

Figure 8:
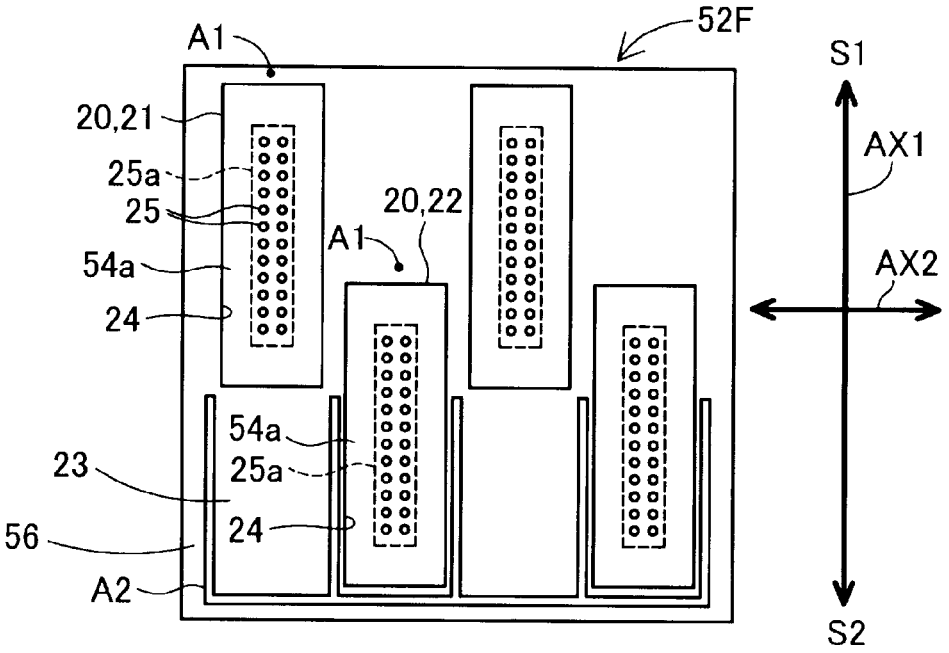
FIG. 8 is a view illustrating a medium-facing surface of a head unit according to a sixth embodiment.

FIG. 8 is a view illustrating a medium-facing surface 56 of the head unit 52F according to a sixth embodiment. In the present embodiment, a common second region A2 extending along the first axis AX1 is provided at a position between two ejection heads 20. Each second region A2 extending in the first axis AX1 is joined to the second region A2 extending in the second axis AX2 on the second side of the nozzle forming range 25*a*. With this configuration as well, it is possible to prevent droplets caused by the mist attached to the head unit 52F from being attached to the recording paper P.

G. Seventh Embodiment

Figure 9:
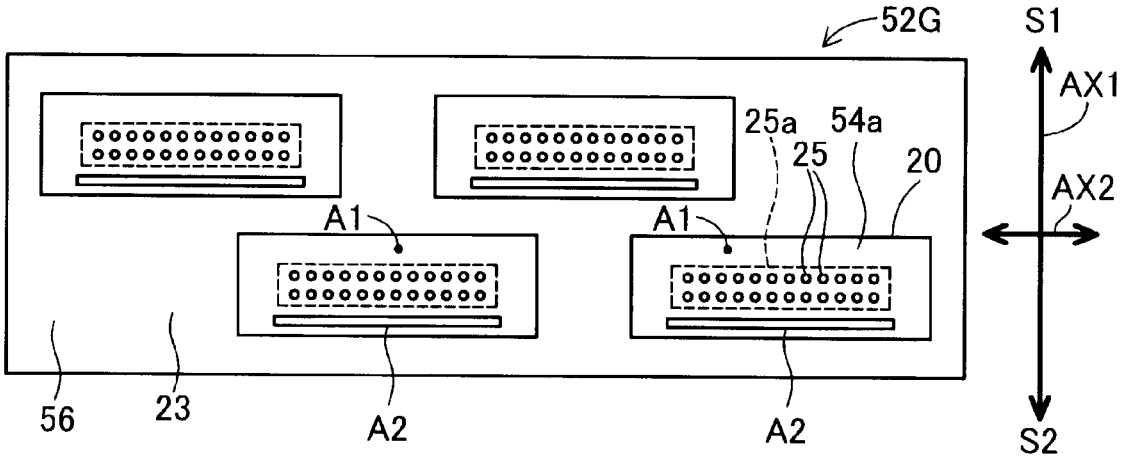
FIG. 9 is a view illustrating a medium-facing surface of a head unit according to a seventh embodiment.

FIG. 9 is a view illustrating a medium-facing surface 56 of the head unit 52G according to a seventh embodiment. In the present embodiment, the ejection head 20 of the head unit 52G is configured as a line head in which a plurality of nozzles 25 are arranged in the second axis AX2. Hereinafter, this configuration of the head unit 52G is referred to as a line head configuration. In the present embodiment, the nozzles 25 of the head unit 52G are arrayed in the width direction of the recording paper P. Accordingly, the head unit 52G of the present embodiment does not reciprocate in the width direction of the recording paper P, and performs recording onto the recording paper P while being fixed at a predetermined position.

In the present embodiment, as in the first embodiment, the first region A1 having water repellency is provided on the nozzle surface 54*a* of the ejection head 20 on the first side on the first axis AX1 relative to the nozzle forming range 25*a*. Further, the second region A2 having water repellency lower than the first region A1 is provided on the second side on the first axis AX1 relative to the nozzle forming range 25*a*. With this configuration, in the head unit 52G having the line head configuration as well, it is possible to prevent droplets caused by the mist attached to the head unit 52G from being attached to the recording paper P.

H. Eighth Embodiment

Figure 10:
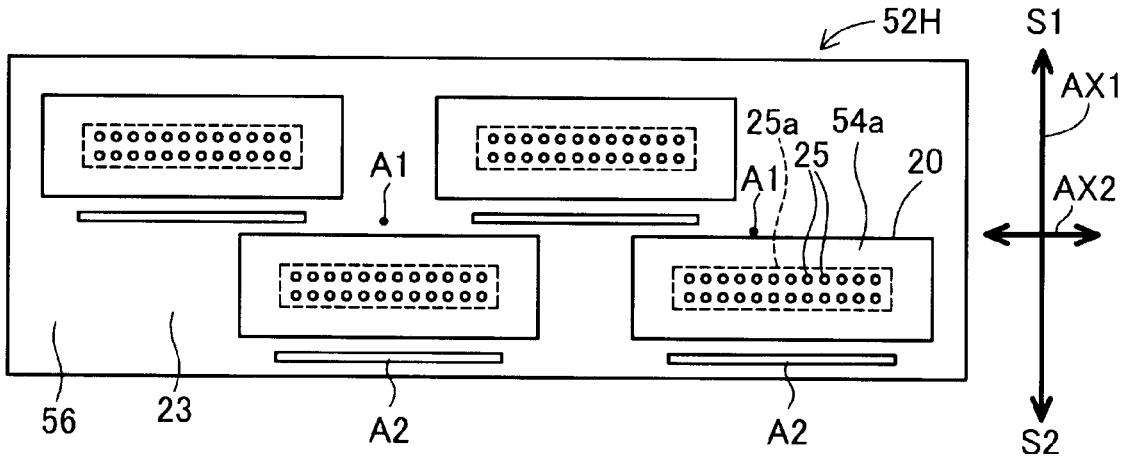
FIG. 10 is a view illustrating a medium-facing surface of a head unit according to an eighth embodiment.

FIG. 10 is a view illustrating a medium-facing surface 56 of the head unit 52H according to an eighth embodiment. In the present embodiment, similar to the head unit 52G shown in FIG. 9, a line head configuration is adopted. Further, as in the second embodiment shown in FIG. 4, the first region A1 and the second region A2 are provided on the fixation plate 23. With this configuration as well, it is possible to prevent droplets from growing on the fixation plate 23 and staining the recording paper P.

I. Ninth Embodiment

Figure 11:
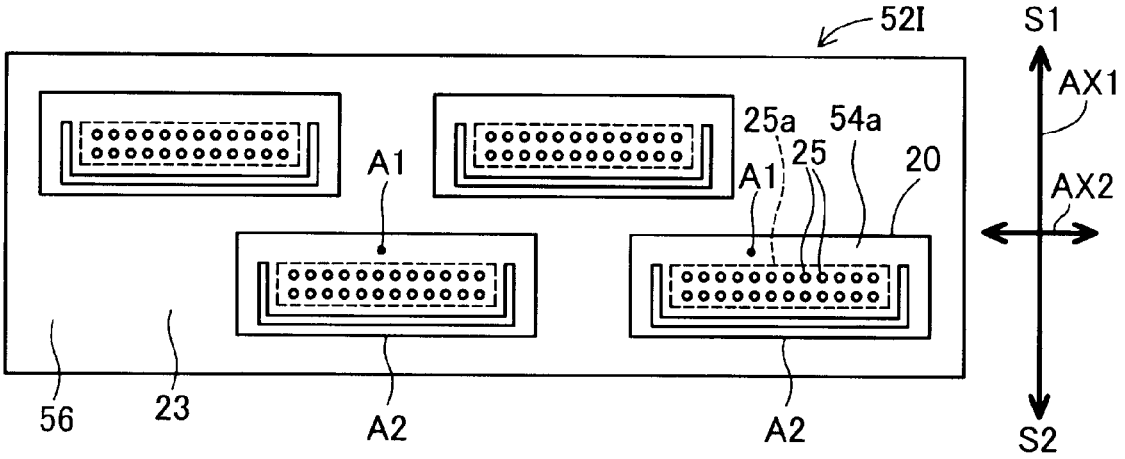
FIG. 11 is a view illustrating a medium-facing surface of a head unit according to a ninth embodiment.

FIG. 11 is a view illustrating a medium-facing surface 56 of the head unit 52I according to a ninth embodiment. In this embodiment as well, a line head configuration is adopted. Further, as in the third embodiment shown in FIG. 5, the second side of the nozzle forming range 25*a* is surrounded by the second region A2 formed in a U-shape. With this configuration as well, it is possible to prevent droplets caused by the mist attached to the head unit 52I from being attached to the recording paper P.

J. Tenth Embodiment

Figure 12:
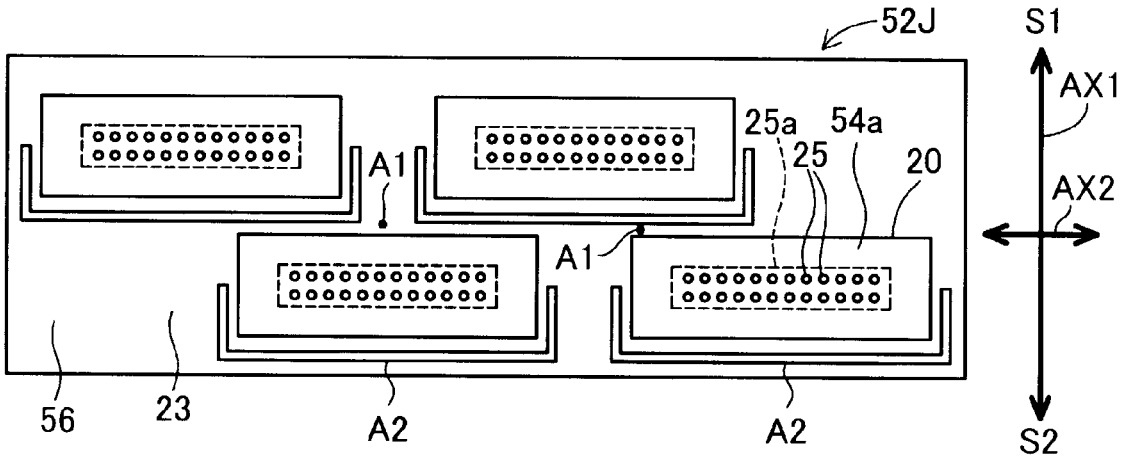
FIG. 12 is a view illustrating a medium-facing surface of a head unit according to a tenth embodiment.

FIG. 12 is a view illustrating a medium-facing surface 56 of the head unit 52I according to a tenth embodiment. In this embodiment as well, a line head configuration is adopted. Further, as in the fourth embodiment shown in FIG. 6, the second side of the nozzle forming range 25*a* is surrounded by the second region A2 formed in a U-shape on the fixation plate 23. With this configuration as well, it is possible to prevent droplets caused by the mist attached to the head unit 52J from being attached to the recording paper P.

K. Eleventh Embodiment

Figure 13:
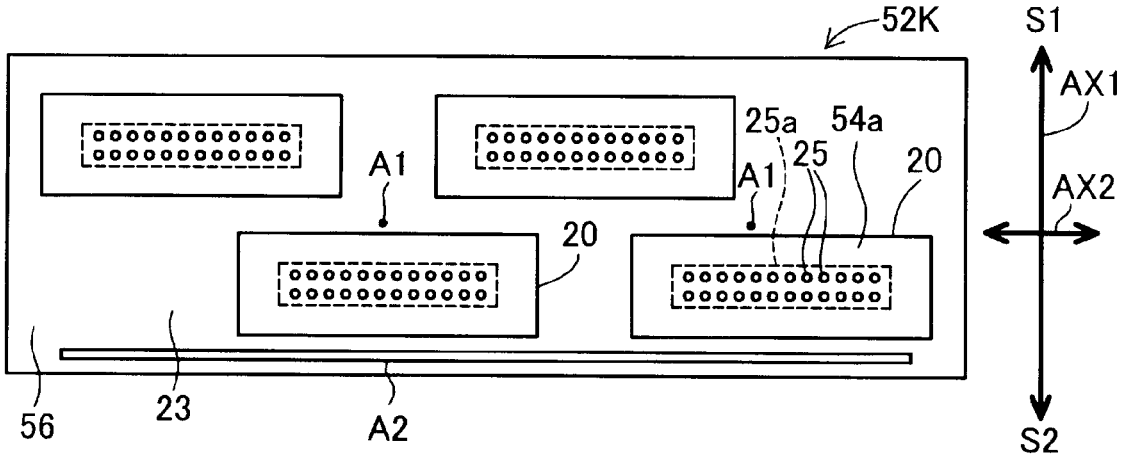
FIG. 13 is a view illustrating a medium-facing surface of a head unit according to an eleventh embodiment.

FIG. 13 is a view illustrating a medium-facing surface 56 of the head unit 52K according to an eleventh embodiment. In this embodiment as well, a line head configuration is adopted. As in the fifth embodiment shown in FIG. 7, one second region A2 common to the plurality of ejection heads 20 of the head unit 52K is provided extending along the second axis AX2 on the second side of the nozzle forming range 25*a*. With this configuration as well, it is possible to prevent droplets caused by the mist attached to the head unit 52K from being attached to the recording paper P.

L. Twelfth Embodiment

Figure 14:
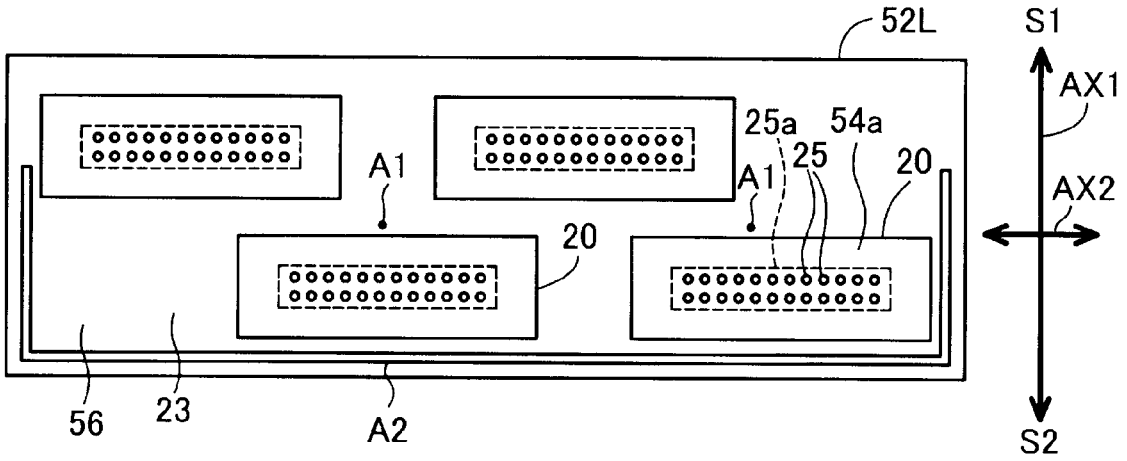
FIG. 14 is a view illustrating a medium-facing surface of a head unit according to a twelfth embodiment.

FIG. 14 is a view illustrating a medium-facing surface 56 of the head unit 52L according to a twelfth embodiment. In this embodiment as well, a line head configuration is adopted. A common second region A2 having a U-shape is provided on the second side of the nozzle forming ranges 25*a* of a plurality of ejection heads 20. With this configuration as well, it is possible to prevent droplets caused by the mist attached to the head unit 52L from being attached to the recording paper P.

M. Thirteenth Embodiment

Figure 15:
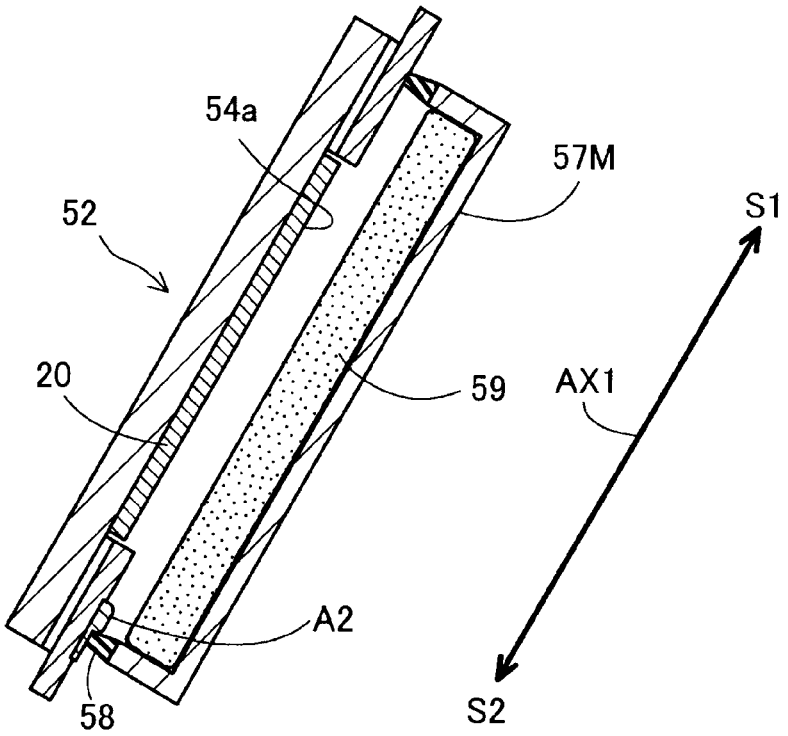
FIG. 15 is a view illustrating a cross-sectional configuration of a cap according to a thirteenth embodiment.

FIG. 15 is a view illustrating a cross-sectional configuration of a cap 57M according to a thirteenth embodiment. In the present embodiment, a contact portion 58 is provided on an end of the cap 57M. The contact portion 58 is in contact with the second region A2 when the nozzle surface 54*a* of the ejection head 20 is sealed by the cap 57M. The contact portion 58 is configured by, for example, joining a rubber on an end of the side wall that surrounds the opening of the cap 57M. With this configuration, the liquid wet-spread on the second region A2 flows along the contact portion 58 into the cap 57M. Accordingly, droplets can be removed from the head unit 52. For example, a liquid absorber 59 is disposed inside the cap 57M so that the liquid flowing into the cap 57M is absorbed by the liquid absorber 59. In addition, for example, a pump may be joined to the cap 57M so that liquid flowing into the cap 57 is discharged outside the cap 57M by the pump. Further, the contact portion 58 is preferably positioned so that it contacts a second side end of the second region A2 when the contact portion 58 comes into contact with the second region A2.

N. Fourteenth Embodiment

Figure 16:
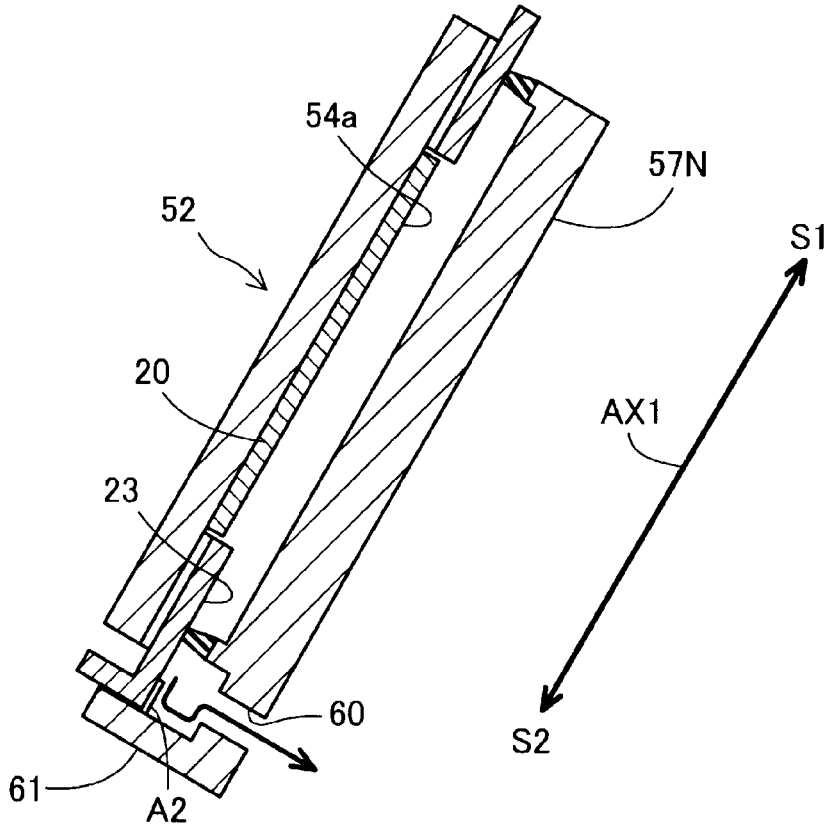
FIG. 16 is a view illustrating a cross-sectional configuration of a cap according to a fourteenth embodiment.

FIG. 16 is a view illustrating a cross-sectional configuration of a cap 57N according to a fourteenth embodiment. The cap 57N of the present embodiment has a flow path 60 at a position outside the range for sealing the nozzle surface 54*a* of the head unit 52. The flow path 60 is configured to contact the second region A2 of the head unit 52 and discharge the liquid to the outside. Specifically, in the present embodiment, the second region A2 extending along the second axis AX2 is provided on a second side end of the fixation plate 23. Further, the cap 57N has a side wall 61 that can contact the second side end of the fixation plate 23. When the nozzle surface 54*a* is sealed by the cap 57N, the side wall 61 of the cap 57N is in contact with the second region A2 so that the liquid is discharged to the outside via the inner surface of the side wall 61 and the flow path 60.

O. Other Embodiments (O-1) In the above embodiments, the head unit 52 is provided with the fixation plate 23. However, the head unit 52 may not be provided with the fixation plate 23. In this case, the head unit 52 can be fixed to, for example, the holder 27 shown in FIG. 3.

(O-2) In the above embodiments, the second region A2 is formed by applying a hydrophilic coating. On the other hand, the hydrophilic second region A2 may also be formed by removing a part of the water repellent coating formed on the nozzle surface 54*a* or the surface of the fixation plate 23. Alternatively, instead of a hydrophilic coating, the second region A2 may also be formed by adhering a hydrophilic material to the nozzle surface 54*a* or the fixation plate 23.

(O-3) In the above embodiments, the nozzle surface 54*a* may be a surface intersecting a horizontal plane. The expression "intersecting a horizontal plane" includes being inclined to the horizontal direction and being vertical to the horizontal direction. In this case, the control unit 10 controls the head unit 52 to perform an ejection operation in a state in which the nozzle surface 54*a* intersects the horizontal plane.

(O-4) In the above embodiments, the head unit 52 is inclined to the horizontal direction when it is mounted in the liquid ejection apparatus 100. On the other hand, for example, the head unit 52 may be configured to change the posture to be inclined to the horizontal direction when it is controlled by the control unit 10 to perform the ejection operation.

(O-5) In the above embodiments, a system in which the nozzle surface 54*a* obliquely intersects the horizontal plane, that is, a system in which the nozzle surface 54*a* forms an angle larger than 0 degree and smaller than 90 degree relative to the horizontal plane is described. However, even in a system in which the nozzle surface 54*a* intersects the horizontal plane at a right angle, that is, the nozzle surface 54*a* is orthogonal to the horizontal plane, the effect described in each embodiment can be obtained. However, when the nozzle surface 54*a* obliquely intersects the horizontal plane, a gravity component to a certain degree acts on the liquid attached to the nozzle surface 54*a* in a direction in which the recording medium exists. Accordingly, liquid grows largely in the direction in which the recording medium exists, and, in particular, the effect described in each embodiment can be suitably obtained.

P. Other Forms

The present disclosure is not limited to the above embodiments and can be embodied in various configurations without departing from the spirit thereof. For example, technical features in the embodiments corresponding to the technical features in the respective embodiments described below can be appropriately replaced or combined in order to solve part or all of the above problems or achieve part or all of the above effects. Further, technical features can be appropriately deleted as long as they are not described in the specification as indispensable features.

(1) According to a first aspect of the present disclosure, a head unit including a first ejection head having a nozzle surface on which nozzles that eject liquid are disposed is provided. In this head unit, a first region having water repellency is provided on a first side on a first axis relative to a range in which the nozzles are formed, the first axis extending along the nozzle surface, and a second region having water repellency lower than the first region is provided on a second side on the first axis relative to the range in which the nozzles are formed. With this configuration, it is possible to prevent the recording medium from being stained by droplets caused by the mist attached to the head unit.

(2) According to a second aspect of the present disclosure, a head unit including a first ejection head having a nozzle surface on which nozzles that eject liquid are disposed is provided. In this head unit, a first region is provided on a first side on a first axis relative to a range in which the nozzles are formed, the first axis extending along the nozzle surface, and a second region having a critical surface tension larger than the first region is provided on a second side on the first axis relative to the range in which the nozzles are formed. With this configuration, it is possible to prevent the recording medium from being stained by droplets caused by the mist attached to the head unit.

(3) In the head unit of the above aspect, on the nozzle surface, the first region may be provided on the first side relative to the range in which the nozzles are formed, and the second region may be provided on the second side relative to the range in which the nozzles are formed. With this configuration, it is possible to prevent the recording medium from being stained by droplets caused by the mist attached to the nozzle surface.

(4) The head unit of the above aspect may further include a fixation plate to which the first ejection head is fixed, the fixation plate having an opening through which the nozzle surface is exposed, wherein, on the fixation plate, the first region may be provided on the first side relative to the range in which the nozzles are formed, and the second region may be provided on the second side relative to the range in which the nozzles are formed. With this configuration, it is possible to prevent the recording medium from being stained by droplets caused by the mist attached to the fixation plate.

(5) In the head unit of the above aspect, the second region may be provided at least on a first side on a second axis relative to the range in which the nozzles are formed, the second axis extending along the nozzle surface and being perpendicular to the first axis. With this configuration, it is possible to more effectively prevent the recording medium from being stained by droplets caused by the mist attached to the head unit.

(6) The head unit of the above aspect may further include a second ejection head having a nozzle surface on which nozzles that eject liquid are disposed, the second ejection head being provided at a position different from the first ejection head, wherein a common second region may be provided on the second side relative to the range in which the nozzles are formed in the first ejection head and on the second side relative to a range in which the nozzles are formed in the second ejection head. With this configuration, it is possible to prevent the recording medium from being stained by droplets caused by the mist attached to the head unit.

(7) In the head unit of the above aspect, the plurality of nozzles may be arrayed on the nozzle surface along the first axis. With this configuration, it is possible to prevent the recording medium from being stained by droplets attached to, for example, a serial type head unit.

(8) In the head unit of the above aspect, the plurality of nozzles may be arrayed on the nozzle surface along the second axis, the second axis extending along the nozzle surface and being perpendicular to the first axis. With this configuration, it is possible to prevent the recording medium from being stained by droplets attached to, for example, a head unit of line head configuration.

(9) In the head unit of the above aspect, when the head unit is mounted in the liquid ejection apparatus and an ejection operation is performed, the nozzle surface may intersect a horizontal plane, the first side may correspond to an upper side, and the second side may correspond to a lower side. With this configuration, it is possible to prevent the recording medium from being stained by droplets caused by the mist attached to the head unit.

(10) In the head unit of the above aspect, the second region may not be provided on the first side relative to the range in which the nozzles are formed. With this configuration, it is possible to more effectively prevent the recording medium from being stained by droplets caused by the mist attached to the head unit.

(11) According to a third aspect of the present disclosure, a liquid ejection apparatus is provided. This liquid ejection apparatus includes a head unit that includes an ejection head having a nozzle surface on which nozzles that eject liquid are disposed; and a control unit that controls the head unit to perform an ejection operation with the nozzle surface intersecting a horizontal plane, wherein a first region having water repellency is provided on an upper side relative to the region in which the nozzles are formed, and a second region having water repellency lower than the first region is provided on a lower side relative to the region in which the nozzles are formed. With this configuration, it is possible to prevent the recording medium from being stained by droplets caused by the mist attached to the head unit.

(12) According to a fourth aspect of the present disclosure, a liquid ejection apparatus is provided. This liquid ejection apparatus includes a head unit that includes an ejection head having a nozzle surface on which nozzles that eject liquid are disposed; and a control unit that controls the head unit to perform an ejection operation with the nozzle surface intersecting a horizontal plane, wherein a first region is provided on an upper side relative to the region in which the nozzles are formed, and a second region having a critical surface tension larger than the first region is provided on a lower side relative to the region in which the nozzles are formed. With this configuration, it is possible to prevent the recording medium from being stained by droplets caused by the mist attached to the head unit.

(13) The liquid ejection apparatus of the above aspect may further include a cap configured to seal the nozzle surface when an ejection operation is not performed by the control unit, wherein the cap may have a contact portion configured to contact the second region when the nozzle surface is sealed. With this configuration, liquid attached to the second region can be removed by using the contact portion of the cap.

The present disclosure can be embodied in various forms other than the head unit and the liquid ejection apparatus described above. For example, the present disclosure can be embodied as an ejection head mounted in the head unit, a fixation plate to which the ejection head is fixed, or the like.

What is claimed is:

1. A head unit comprising a first ejection head having a first nozzle surface including first nozzles configured to eject liquid, wherein a first region having water repellency is provided on a first side on a first axis with respect to a range in which the first nozzles are formed, the first axis extending along the first nozzle surface, a second region having water repellency lower than the first region is provided on a second side on the first axis with respect to the range in which the first nozzles are formed, at least a portion of the second region extending longitudinally across the first axis, and a third region having water repellency lower than the first region is not provided on the first side with respect to the range in which the first nozzles are formed, the third region being different from the second region.

2. The head unit according to claim 1, wherein, the first region and the second region are provided on the first nozzle surface.

3. The head unit according to claim 1, further comprising a fixation plate to which the first ejection head is fixed, the fixation plate having an opening through which the first nozzle surface is exposed, wherein, the first region and the second region are provided on the fixation plate, and the opening exposes at least the two first nozzles.

4. The head unit according to claim 1, wherein the second region is provided at least on a first side on a second axis with respect to the range in which the first nozzles are formed, the second axis extending along the first nozzle surface and crossing the first axis.

5. The head unit according to claim 1, further comprising a second ejection head having a second nozzle surface including second nozzles configured to eject, the second ejection head being provided at a position different from the first ejection head, wherein the second region is provided on the second side with respect to the range in which the first nozzles are formed in the first ejection head and on the second side with respect to a range in which the second nozzles are formed in the second ejection head.

6. The head unit according to claim 1, wherein the first nozzles are arrayed on the first nozzle surface along the first axis.

7. The liquid ejection apparatus according to claim 6, further comprising a cap configured to seal the first nozzle surface when an ejection operation is not performed by the control unit, wherein the cap has a contact portion configured to contact the second region when the first nozzle surface is sealed.

8. The head unit according to claim 1, wherein, when the head unit is mounted in the liquid ejection apparatus and an ejection operation is performed, the first nozzle surface intersects a horizontal plane, the first side corresponds to an upper side, and the second side corresponds to a lower side.

9. A liquid ejection apparatus comprising:

the head unit according to claim 1; and a control unit controlling the head unit to perform an ejection operation with the first nozzle surface intersecting a horizontal plane, wherein the first region is provided on an upper side with respect to the region in which the first nozzles are formed, and the second region is provided on a lower side with respect to the region in which the first nozzles are formed.

10. The head unit according to claim 1, wherein the portion of the second region extends along a second axis, the second axis extending along the first nozzle surface and crossing the first axis, and a length of the portion of the second region with respect to a direction that the second axis extends is longer than a diameter of the first nozzle with respect to the direction.

11. The head unit according to claim 1, wherein a fourth region having water repellency lower than the first region is not provided on the second side with respect to the second region, the region being different from the second region.

12. The head unit according to claim 11, wherein a portion of the first region is located between the second region and the first nozzle.

13. The head unit according to claim 11, wherein the second region is adjacent to the first region on both a first side and a second side of the second region on the first axis.

14. The head unit according to claim 11, wherein any one of nozzles configured to eject liquid is not provided on the second side with respect to the second region.

15. The head unit according to claim 11, further comprising a medium-facing surface including the first nozzle surface, wherein a portion of the first region is provided on a second side end of the medium-facing surface.

16. A head unit comprising a first ejection head having a first nozzle surface including first nozzles configured to eject liquid, wherein a first region is provided on a first side on a first axis with respect to a range in which the first nozzles are formed, the first axis extending along the first nozzle surface, a second region having a critical surface tension larger than the first region is provided on a second side on the first axis with respect to the range in which the first nozzles are formed, at least a portion of the second region extending longitudinally across the first axis, and a third region having a critical surface tension larger than the first region is not provided on the first side with respect to the range in which the first nozzles are formed, the third region being different from the second region.

17. The head unit according to claim 16, wherein, the first region and the second region are provided on the first nozzle surface.

18. The head unit according to claim 16, wherein the first nozzles are arrayed on the first nozzle surface along the first axis.

19. The head unit according to claim 16, wherein, when the head unit is mounted in the liquid ejection apparatus and an ejection operation is performed, the first nozzle surface intersects a horizontal plane, the first side corresponds to an upper side, and the second side corresponds to a lower side.

20. A liquid ejection apparatus comprising:

the head unit according to claim 16; and a control unit controlling the head unit to perform an ejection operation with the first nozzle surface intersecting a horizontal plane, wherein the first region is provided on an upper side with respect to the region in which the first nozzles are formed, and the second region is provided on a lower side with respect to the region in which the first nozzles are formed.

* * * * *